US005918486A

United States Patent [19]

Park

[11] Patent Number: 5,918,486

[45] Date of Patent: Jul. 6, 1999

[54] WASHING MACHINE HAVING AN APPARATUS FOR GENERATING A TURBULENT FLOW IN A SPIN TUB

[75] Inventor: Kwan-Choul Park, Kwangju-Shi, Rep. of Korea

[73] Assignee: Daewoo Electronics Co., Ltd., Seoul, Rep. of Korea

[21] Appl. No.: 08/988,357

[22] Filed: Dec. 10, 1997

[30] Foreign Application Priority Data

Feb. 28, 1997 [KR] Rep. of Korea ..... 97-6432

[51] Int. Cl.[6] ..... D06F 3/39

[52] U.S. Cl. ..... 68/53; 68/133; 68/134

[58] Field of Search ..... 68/53, 133, 134

[56] References Cited

U.S. PATENT DOCUMENTS

| | | | |
|---|---|---|---|
| 2,899,817 | 8/1959 | Smith | 68/133 |
| 4,402,198 | 9/1983 | Cartier | 68/53 X |
| 5,142,887 | 9/1992 | Priem et al | 68/18 FA |
| 5,487,284 | 1/1996 | Kim et al. | 68/131 |
| 5,595,072 | 1/1997 | Bai et al. | 68/133 |

FOREIGN PATENT DOCUMENTS

| | | | |
|---|---|---|---|
| 274285 | 11/1990 | Japan | 68/134 |
| 2 308 136 | 6/1997 | United Kingdom . | |
| 2 308 606 | 7/1997 | United Kingdom . | |

*Primary Examiner*—Philip R. Coe

*Attorney, Agent, or Firm*—Pillsbury Madison & Sutro LLP

[57] ABSTRACT

A washing machine having an apparatus for generating a turbulent flow. The washing machine has a cabinet, an outer tub installed in the cabinet to receive a washing water, a spin tub mounted in the outer tub to receive articles, an apparatus installed at a lower portion of the spin tub to upwardly impel the washing water, a pulsator to guide the washing water impelled by the apparatus into a center portion of the spin tub and to generate a swirling flow in the spin tub, a motor and a power transmission to drive the apparatus and pulsator. The apparatus has a porous cap member to allow the washing water to flow thereinto and an impeller to upwardly impel the washing water flown thereinto. The washing machine can impel the washing water toward an upper portion of the spin tub while a washing operation is being carried out so that the apparatus generates a complicated turbulent flow in the spin tub, thereby improving a washing efficiency.

11 Claims, 3 Drawing Sheets

WASHING MACHINE HAVING AN APPARATUS FOR GENERATING A TURBULENT FLOW IN A SPIN TUB

BACKGROUND OF THE INVENTION

1. Field of the Invention

The present invention relates to a washing machine, and more particularly to a washing machine which can generate a turbulent flow in a spin tub by upwardly impelling a washing water from a center of a lower portion of the spin tub.

2. Description of the Prior Art

As is well known, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the articles separates from the articles by means of friction between a liquid flow and the articles or by means of detergents.

FIG. 1 shows a conventional washing machine 100.

As shown in FIG. 1, washing machine 100 comprises a cabinet 110. An outer tub 120 is mounted inside of cabinet 110 for receiving a washing water therein. A spin tub 130 is rotatably mounted on a lower portion of outer tub 120 for receiving articles to be washed therein. Spin tub 130 is formed at a circumferential outer wall thereof with a plurality of apertures 135 so as to fluidly communicate with outer tub 120 therethrough. A motor 140 is secured to a predetermined position of an underside of outer tub 120, and a power transmission 150 is secured to a center position of outer tub 120 and receives a torque generated by motor 140 through a belt 145. Spin tub 130 is coupled to a first shaft upwardly extending from motor 140 so as to rotate while the dehydrating operation is being carried out. A pulsator 160 for generating a swirling flow is rotatably mounted at a lower portion of spin tub 130 and is coupled to a second shaft 154 upwardly extending separately from first shaft 152.

Pulsator 160 receives an oscillating torque generated by motor 140 which generates an oscillating torque in alternative directions through second shaft 154 so as to generate a swirl flow, thereby washing the articles.

A draining device 180 for draining the washing water in outer tub 120 is installed at a predetermined position of the underside of outer tub 120.

In washing machine 100 constructed as described above, a user tosses articles into spin tub 130 and adjusts a washing parameter such as a washing time and an amount of washing water to be supplied by adjusting a control panel(not shown). When a predetermined amount of the washing water is supplied into spin tub 130, motor 140 is actuated so as to transfer a torque generated by motor 140 to power transmission 150 through belt 145. At this time, power transmission 150 transforms the torque to a reduced rotational speed so as to rotate pulsator 160.

In brief, pulsator 160 is rotated by second shaft 154 so as to generate the swirl flow in spin tub 130, thereby washing the articles. While the washing and the rinsing operations are being carried out, pulsator 160 is alternatively rotated in clockwise and counter-clockwise directions.

Meanwhile, a plurality of rods 170 and a plurality of dampers 175 are provided in order to damp a vibration generated by a rotation of the articles and spin tub 130, and to uniformly apply the vibration to cabinet 110. Dampers 175 are installed at a lower portion of an outside wall of outer tub 120 spaced apart from each other, and each of rods 170 has a first edge portion connected to an upper portion of cabinet 110 and a second edge portion connected to each of dampers 175 so as to suspend outer tub 120 at cabinet 110.

In refrigerator 100 having the above-described structure, pulsator 160 rotates so as to generate the swirl flow in spin tub 130. The swirl flow ascends along an inner wall of spin tub 130 and descends from a center portion of an upper part of spin tub 130. Subsequently, the articles moving with the swirl flow are tangled with each other at the center portion of spin tub 130, thereby reducing a washing efficiency of washing machine 100.

To overcome the above-described disadvantage, washing machines which upwardly pump the washing water so as to prevent the articles from tangling in a center portion of a spin tub, thereby improving the washing efficiency, are disclosed. U.S. Pat. No. 4,402,198 issued to Cartier discloses a washing machine having an agitator for pumping a washing water. However, the agitator has a structure by which the agitator itself vertically moves, which results in making the structure complicated so that it is difficult to assemble the agitator into a washing machine.

SUMMARY OF THE INVENTION

The present invention is intended to overcome the above described disadvantage. Therefore, it is an object of the present invention to provide a washing machine having an apparatus which can generate an ascending flow at a center portion in a spin tub.

In order to achieve the above object of the present invention, there is provided a washing machine comprising:

- a spin tub rotatably mounted on a lower portion of an outer tub;
- a first means for upwardly impelling a washing water, the first means being rotatably mounted at a lower portion of the spin tub;
- a second means for guiding the washing water impelled by the first means toward a center portion of the spin tub, and for generating a swirl flow in the spin tub; and
- a third means for simultaneously driving the first means and the second means.

The third means includes a motor secured to a predetermined position of an underside of the outer tub, a power transmission which is secured to a center position of the underside of the outer tub and connected to the motor by a belt for receiving a torque generated by the motor so as to output a changed rotating speed, and a rotating shaft upwardly extending by passing through a bottom wall of the spin tub such that a portion of the rotating shaft is protruded into the spin tub by a predetermined length.

The first means includes a bottom plate fixedly coupled to a predetermined position of a protruded portion of the rotating shaft, a porous cap member which allows the washing water to flow thereinto, and an impeller for sucking and upwardly impelling the washing water passing through the porous cap member and flowing therein, the porous cap member being fixedly assembled with the bottom plate.

According to a preferred embodiment of the present invention, the bottom plate has a circular shape and is formed at a circumferential portion thereof with a plurality of first holes, the porous cap member has an annular shape and is formed at a circumferential portion thereof with a plurality of second holes, each of which is formed in correspondence to each of first holes so as to be fixedly assembled with the bottom plate by screws, and is formed at a circumferential outer wall thereof with a plurality of apertures so as to allow the washing water to flow thereinto.

The impeller is coupled to a free end of the rotating shaft and radially sucks and upwardly impels the washing water.

According to a preferred embodiment of the present invention, a one-way bearing is provided between the impeller and the rotating shaft so that when the rotating shaft rotates in a first direction where the impeller sucks the washing water from a radially outside thereof, the impeller is rotated together with the rotating shaft, and when the rotating shaft rotates in a second direction which is opposite to the first direction, the impeller is maintained stationary.

The impeller has a rotating disc and a plurality of blades integrally formed on the rotating disc, the rotating disc having a hole at a center thereof, the one-way bearing being inserted into the hole.

According to a preferred embodiment of the present invention, the impeller is inserted around a predetermined position of the rotating shaft substantially corresponding to a position of the porous cap member in such a manner that the impeller is radially spaced apart from an inner wall of the porous cap member.

The second means includes a pulsator, the pulsator being mounted at an upper portion of the porous cap member and being formed at a circumferential portion thereof with a plurality of third holes, each of which is in correspondence with each of the second holes, the pulsator being formed at a bottom surface thereof with a conical recess having upwardly decreasing cross-sectional area, being formed at a center portion thereof with an opening so that the washing water upwardly impelled by the impeller is impelled into a center portion of the spin tub through the recess and the opening, and being integrally and radially formed at an upper surface thereof with a plurality of blades so as to generate the swirl flow in the spin tub by a rotation of the pulsator.

Screws are inserted into the first, second and third holes so that the bottom plate, the porous cap member and the pulsator are fixedly assembled with each other.

Preferably, the bottom plate is formed with a plurality of apertures so as to allow the washing water to flow thereinto.

According to a preferred embodiment of the present invention, the porous cap member is made of rubber.

The washing machine having an apparatus for generating a turbulent flow in a spin tub can impel a washing water toward an upper portion of the spin tub while a washing operation is being carried out so as to generate a complicated turbulent flow in the spin tub, thereby improving a washing efficiency.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a washing machine having an apparatus for generating a turbulent flow according to a preferred embodiment of the present invention will be explained in more detail with reference to the accompanying drawings.

Figure 1:
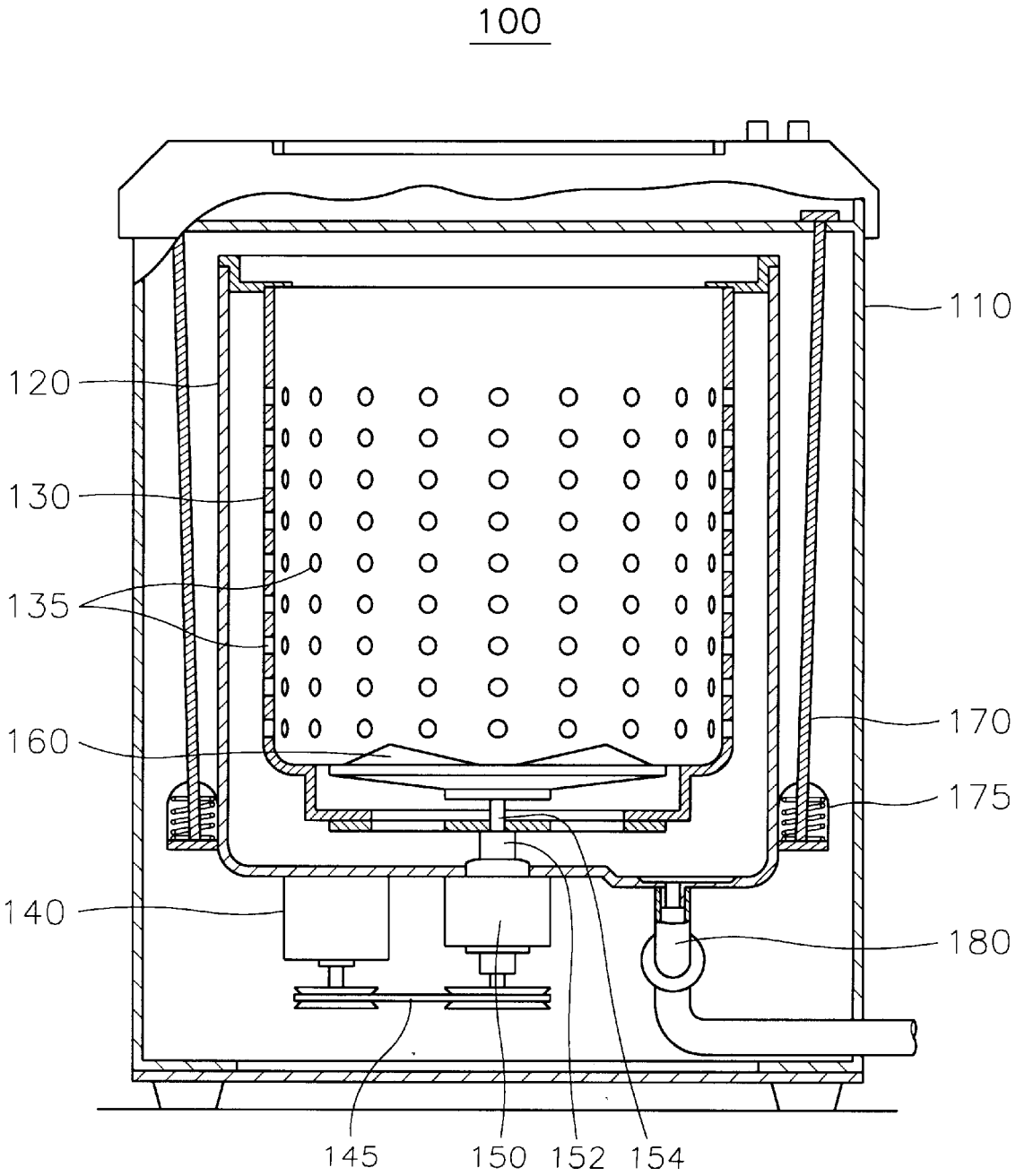
FIG. 1 (PRIOR ART)
FIG. 1 is a cross-sectional view showing an inner structure of a conventional washing machine.
Figure 2:
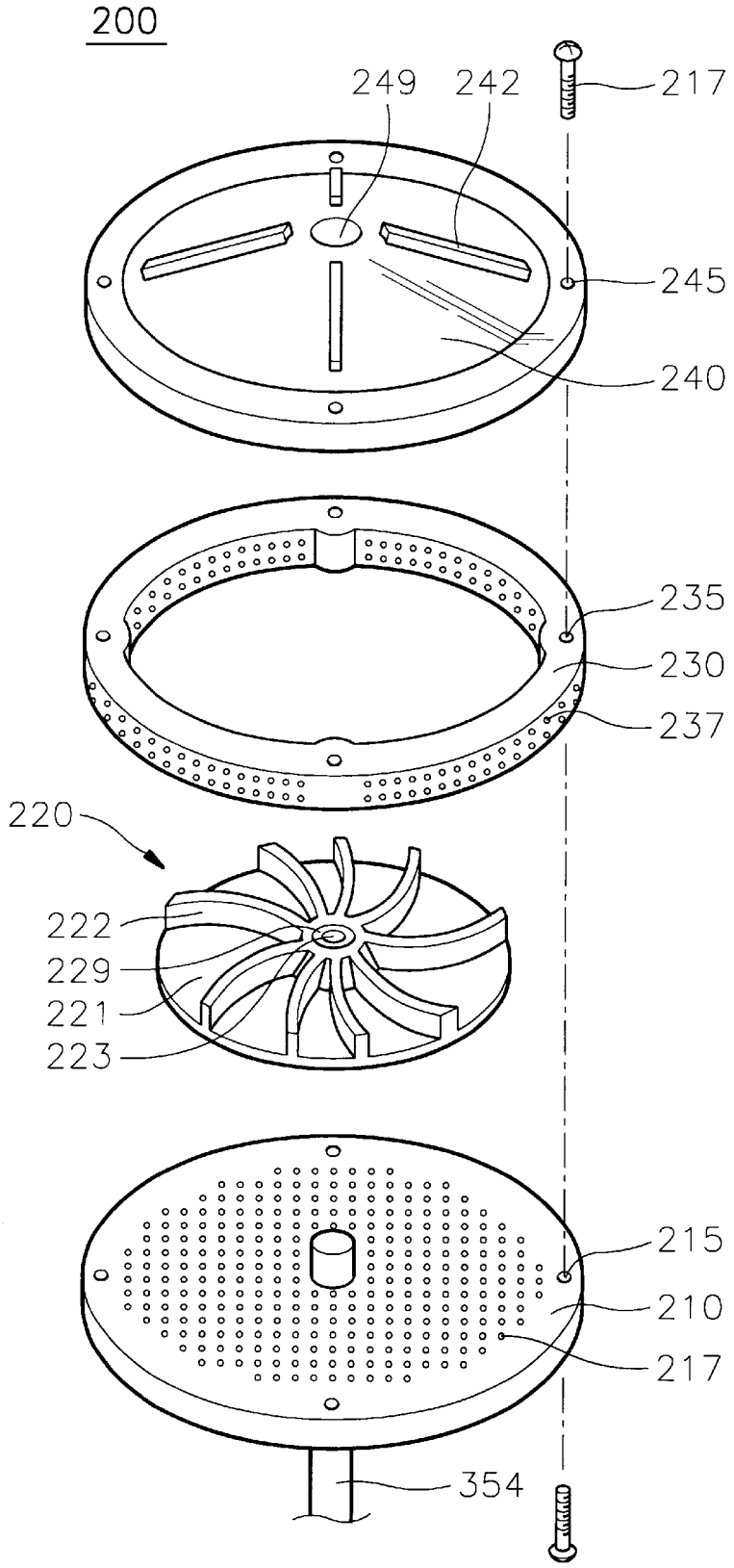
FIG. 2 is an exploded perspective view showing an apparatus for generating a turbulent flow according to the present invention.
Figure 3:
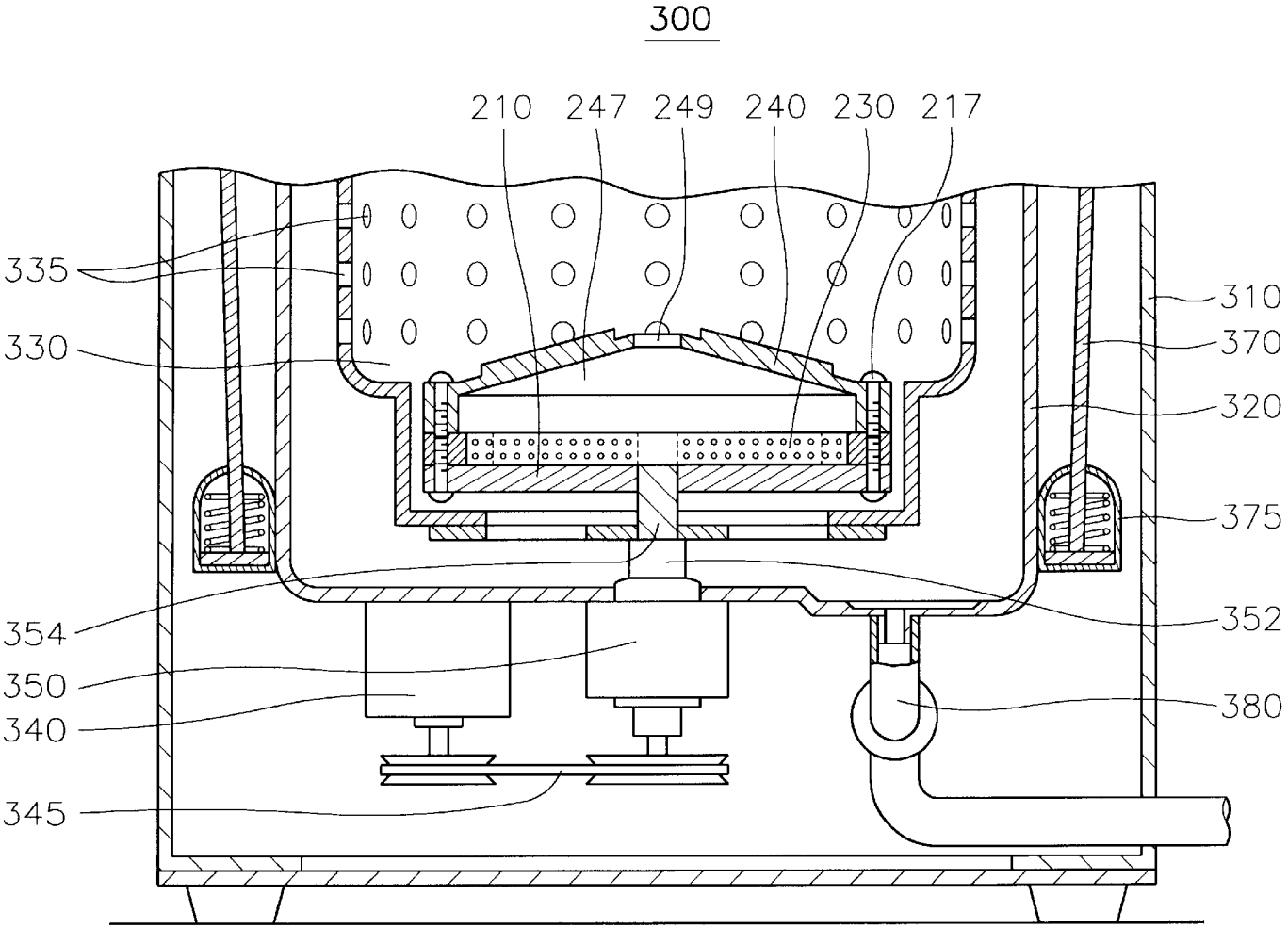
FIG. 3 is a cross-sectional view showing an inner structure of a conventional washing machine having an apparatus for generating a turbulent flow according to the present invention.

FIG. 2 and FIG. 3 shows an apparatus for generating a turbulent flow 200 and a washing machine 300 having apparatus for generating a turbulent flow 200, respectively.

Washing machine 300 comprises a cabinet 310. An outer tub 320 is mounted inside of cabinet 110 for receiving a washing water therein. A spin tub 330 is rotatably mounted on a lower portion of outer tub 320 for receiving articles to be washed therein. Spin tub 330 is formed at a circumferential outer wall thereof with a plurality of apertures 335 so as to fluidly communicate with outer tub 320 therethrough.

A motor 340 is secured to a predetermined position of an underside of outer tub 320. A power transmission 350 is secured to a center position of the underside of outer tub 320 and is connected to motor 340 by a belt 345 for transferring a torque generated by motor 340 so as to generate a reduced rotational speed. Spin tub 330 is coupled to a first rotating shaft 352 upwardly extending from power transmission 350 so as to rotate together with first rotating shaft 352 while the dehydrating operation is being carried out. On the other hand, a second rotating shaft 354 which is provided separately from first rotating shaft 352, upwardly extends through a bottom wall of spin tub 330 such that a portion of second rotating shaft 354 is protruded into spin tub 330 by a predetermined length.

Meanwhile, a plurality of rods 370 and a plurality of dampers 375 are provided in order to damp a vibration generated by a rotation of the articles and spin tub 330, and to uniformly apply the vibration to cabinet 310. Dampers 375 are installed at a lower portion of an outside wall of outer tub 320 spaced apart from each other, and each of rods 370 have a first edge portion connected to an upper portion of cabinet 310 and a second edge portion connected to each of dampers 375 so as to suspend outer tub 320 at cabinet 310.

A draining device 380 for draining the washing water in outer tub 320 is installed at a predetermined position of the underside of outer tub 320.

Apparatus for generating a turbulent flow 200 is installed at a lower portion of spin tub 330 coupled to second shaft 354.

Hereinafter, the construction of apparatus for generating a turbulent flow 200 will be explained in detail with reference to the accompanying drawings.

Apparatus for generating a turbulent flow 200 comprises a bottom plate 210 and a porous cap member 230.

Bottom plate 210 is coupled to a predetermined position of a protruded portion of second rotating shaft 354. Bottom plate 210 has a circular shape and is formed at a circumferential portion thereof with a plurality of first holes 215. Porous cap member 230 for allowing the washing water to flow thereinto is fixedly assembled with bottom plate 210. Porous cap member 230 has an annular shape and is formed at a circumferential portion thereof with a plurality of second holes 235, each of which is formed in correspondence with each of first holes 215 so as to be fixedly assembled with bottom plate 210 by screws 217. Porous cap member 230 is formed at a circumferential outer wall thereof with a plurality of apertures 237 so as to allow the washing water to flow thereinto. Impeller 220 is provided for sucking the washing water and upwardly impelling the washing water passing through porous cap member 230 and flowing therein and is coupled to a free end of second rotating shaft 354 so as to rotate together with second rotating shaft 354, thereby sucking from a radially outside thereof the washing water passed through porous cap member 230 and upwardly impelling the washing water.

As shown in FIG. 2, when impeller 220 rotates in the counter-clockwise direction, impeller 220 sucks the washing water from a radially outside thereof and upwardly impels the washing water. However, when impeller 220 rotates in the clockwise direction, the washing water flows in an opposite direction. Therefore, there is a need to control a rotation of impeller 220 according to a direction of second rotating shaft 354. A one-way bearing 229 therefore serves as a control means and is provided between impeller 220 and second rotating shaft 354 so that when second rotating shaft 354 rotates in the counter-clockwise direction where impeller 220 sucks the washing water from a radially outside thereof, impeller 220 is rotated together with second rotating shaft 354, and when second rotating shaft 354 rotates in the clockwise direction, impeller 220 is maintained stationary.

Impeller 220 comprises a rotating disc 211 and a plurality of blades 222 integrally formed at an upper surface of rotating disc 211. One-way bearing 229 is inserted into a hole 223 formed at a center of rotating disc 211.

Preferably, impeller 220 is disposed around a predetermined position of second rotating shaft 354 substantially corresponding to a position of porous cap member 230 in such a manner that impeller 220 is radially spaced apart from an inner wall of porous cap member 230.

Pulsator 240 guides the washing water impelled by impeller 220 toward a center portion of spin tub 330. Pulsator 240 is mounted at an upper portion of porous cap member 230 and is formed at a circumferential portion thereof with a plurality of third holes 245, each of which is in correspondence with each of second holes 235 so as to be fixedly assembled with porous cap member 230 by screws 217. As shown in FIG. 3, pulsator 240 is formed at a bottom surface thereof with a conical recess 247 having an upwardly decreasing cross-sectional area, and is formed at a center portion thereof with an opening 249 so that the washing water upwardly impelled by impeller 220 is impelled into a center portion of spin tub 330 through recess 247 and opening 249.

In addition, pulsator 240 is integrally and radially formed at an upper surface thereof with a plurality of blades 242 so as to generate the swirl flow in spin tub 330 by a rotation of pulsator 240.

In brief, screws 217 are inserted into first, second and third holes 215, 235 and 245 so that bottom plate 210, porous cap member 230 and pulsator 240 are fixedly assembled with each other.

Preferably, bottom plate 210 is formed with a plurality of apertures 217 so as to allow the washing water to flow thereinto, thereby activating an inflow of the washing water.

According to a preferred embodiment of the present invention, porous cap member 230 is made of rubber.

Hereinafter, the operation of washing machine 300 having apparatus for generating a turbulent flow 200 according to the present invention will be explained.

When a washing water is supplied into spin tub 330, motor 340 is actuated so as to start a washing operation. Power transmission 350 receives a torque generated by motor 340 through belt 345 and transfers a reduced rotational speed to second rotating shaft 354 so as to rotate impeller 220. Impeller 220 sucks the washing water from a radially outside thereof and simultaneously, the washing water continuously flows thereinto by passing through apertures 237 and 217 formed at porous cap member 230 and bottom plate 210, respectively. The washing water sucked by impeller 220 is upwardly impelled and then guided by recess 247 formed at the bottom surface of pulsator 240, and is impelled through opening 249 formed at the center portion of pulsator 240 into the center portion of spin tub 330. At the same time, pulsator 240 rotates so as to generate a swirl flow in spin tub 330. The upwardly impelled flow is mixed with the swirl flow so as to generate a complicated turbulent flow in spin tub 330 so that the tangling of the articles is minimized, thereby improving the washing efficiency.

As described above, the washing machine having an apparatus for generating a turbulent flow in a spin tub can upwardly impel a washing water to a center portion of the spin tub while a washing operation is being carried out so that the apparatus generates a complicated turbulent flow in the spin tub, thereby improving a washing efficiency.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A washing machine comprising:

a spin tub rotatably mounted on a lower portion of an outer tub;

a motor secured to an underside of the outer tub, the motor having a rotating shaft extending upwardly through a bottom wall of the spin tub such that a portion of the rotating shaft protrudes into the spin tub by a predetermined length;

a first means for upwardly impelling a washing water, the first means including a bottom plate coupled to a predetermined position of the rotating shaft, a porous cap member which allows the washing water to flow therethrough and an impeller for sucking and upwardly impelling the washing water passing through the porous cap member, the porous cap member being fixedly assembled with the bottom plate; and a second means for guiding the washing water impelled by the first means toward a center portion of the spin tub, and for generating a swirl flow in the spin tub.

2. The washing machine according to claim 1, wherein a power transmission is secured to a center position of the underside of the outer tub and is connected to the motor by a belt for receiving a torque generated by the motor so as to output a changed rotating speed.

3. The washing machine according to claim 1, wherein the bottom plate has a circular shape and is formed at a circumferential portion thereof with a plurality of first holes, the porous cap member has an annular shape and is formed at a circumferential portion thereof with a plurality of second holes, each of which is formed in correspondence with each of first holes so as to be fixedly assembled with the bottom plate by screws, and is formed at a circumferential outer wall thereof with a plurality of apertures so as to allow the washing water to flow thereinto.

4. The washing machine according to claim 3, wherein the second means includes a pulsator, the pulsator being mounted at an upper portion of the porous cap member and being formed at a circumferential portion thereof with a plurality of third holes, each of which is in correspondence with each of the second holes, the pulsator being formed at a bottom surface thereof with a conical recess having an upwardly decreasing cross-sectional area and being formed at a center portion thereof with an opening so that the washing water upwardly impelled by the impeller is impelled into a center portion of the spin tub through the recess and the opening, the pulsator being integrally and radially formed at an upper surface thereof with a plurality of blades so as to generate the swirl flow in the spin tub by a rotation of the pulsator.

5. The washing machine according to claim 4, wherein screws are inserted into the first, second and third holes so that the bottom plate, the porous cap member and the pulsator are fixedly assembled with each other.

6. The washing machine according to claim 1, wherein the impeller is coupled to a free end of the rotating shaft and radially sucks and upwardly impels the washing water.

7. The washing machine according to claim 6, wherein a one-way bearing is provided between the impeller and the rotating shaft so that when the rotating shaft rotates in a first direction where the impeller sucks the washing water from a radially outside thereof, the impeller is rotated together with the rotating shaft, and when the rotating shaft rotates in a second direction which is opposite to the first direction, the impeller is maintained stationary.

8. The washing machine according to claim 7, wherein the impeller has a rotating disc and a plurality of blades integrally formed on the rotating disc, the rotating disc having a hole at a center thereof, the one-way bearing being inserted into the hole.

9. The washing machine according to claim 6, wherein the impeller is disposed around a predetermined position of the rotating shaft substantially corresponding to a position of the porous cap member in such a manner that the impeller is radially spaced apart from an inner wall of the porous cap member.

10. The washing machine according to claim 1, wherein the bottom plate is formed with a plurality of apertures so as to allow the washing water to flow thereinto.

11. The washing machine according to claim 1, wherein the porous cap member is made of rubber.

* * * * *